US006209557B1

(12) United States Patent
Zheng

(10) Patent No.: US 6,209,557 B1
(45) **Date of Patent: *Apr. 3, 2001**

(54) COLLAPSIBLE STRUCTURES

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,211

(22) Filed: Apr. 3, 2000

Related U.S. Application Data

(63) Continuation of application No. 09/059,811, filed on Apr. 14, 1998, which is a continuation-in-part of application No. 08/773,066, filed on Dec. 26, 1996, now Pat. No. 5,778,915.

(51) Int. Cl.[7] ..... E04H 15/40
(52) U.S. Cl. ..... 135/126; 135/119; 135/125
(58) Field of Search ..... 135/126, 119, 135/125

(56) References Cited

U.S. PATENT DOCUMENTS

| | | | | |
|---|---|---|---|---|
| 3,826,270 | * | 7/1974 | Hentges | 135/149 X |
| 3,847,170 | * | 11/1974 | Anderson | 135/143 X |
| 3,960,161 | | 6/1976 | Norman . | |
| 3,990,463 | | 11/1976 | Norman . | |
| 4,000,585 | | 1/1977 | Denaro . | |
| 4,085,762 | * | 4/1978 | O'Brian et al. | 135/149 X |
| 4,590,956 | * | 5/1986 | Griesenbeck | 135/127 X |
| 4,815,784 | | 3/1989 | Zheng . | |
| 4,825,892 | | 5/1989 | Norman . | |
| 4,858,634 | | 8/1989 | McLeese . | |
| 4,858,635 | * | 8/1989 | Eppenbach | 135/125 |
| 4,951,333 | | 8/1990 | Kaiser et al. . | |
| 5,038,812 | | 8/1991 | Norman . | |
| 5,137,044 | | 8/1992 | Brady . | |
| 5,163,461 | | 11/1992 | Ivanovich et al. . | |
| 5,249,592 | * | 10/1993 | Springer et al. | 135/126 |
| 5,370,145 | | 12/1994 | Wu . | |
| 5,385,165 | | 1/1995 | Hazinski et al. . | |
| 5,439,017 | | 8/1995 | Brown . | |
| 5,439,018 | * | 8/1995 | Tsai | 135/126 X |
| 5,467,794 | | 11/1995 | Zheng . | |
| 5,560,385 | | 10/1996 | Zheng . | |
| 5,562,115 | * | 10/1996 | Sotelo | 135/137 X |
| 5,582,197 | * | 12/1996 | Dobberstein | 135/127 X |
| 5,592,961 | | 1/1997 | Chin . | |
| 5,601,105 | | 2/1997 | Bien et al. . | |
| 5,645,096 | | 7/1997 | Hazinski et al. . | |
| 5,676,168 | | 10/1997 | Price . | |
| 5,778,915 | * | 7/1998 | Zheng | 135/126 |
| 5,800,067 | | 9/1998 | Easter . | |
| 5,816,278 | | 10/1998 | Kim . | |
| 5,935,683 | * | 8/1999 | Liyama | 428/141 |

FOREIGN PATENT DOCUMENTS

| | | | | |
|---|---|---|---|---|
| 399025 | * | 6/1909 | (FR) | 135/137 |
| 2635136 | | 2/1990 | (FR) . | |
| 2263920 | | 10/1995 | (GB) . | |
| 8-57164 | | 3/1996 | (JP) . | |

* cited by examiner

*Primary Examiner*—Beth A. Stephan
(74) *Attorney, Agent, or Firm*—Raymond Sun

(57) ABSTRACT

A collapsible structure has first and second wall panels, each wall panel having a foldable frame member having a folded and an unfolded orientation, a frame retaining sleeve for retaining the respective frame member, and a fabric material substantially covering each frame member to form the panel for each frame member when the frame member is in the unfolded orientation. The fabric assumes the unfolded orientation of its associated frame member. The foldable frame member for each wall panel further includes a top side and a bottom side, with the frame retaining sleeve of the first wall panel stitched along the length of its top side to the frame retaining sleeve along the length of the top side of the second wall panel to form a hinged connection.

25 Claims, 11 Drawing Sheets

COLLAPSIBLE STRUCTURES

This is a continuation of application Ser. No. 09/059,811, filed on Apr. 14, 1998, which is a continuation-in-part of Ser. No. 08/773,066, filed Dec. 26, 1996, entitled "Collapsible Structures", now U.S. Pat. No. 5,778,915.

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the structures to facilitate convenient storage and use.

2. Description of the Prior Art

Collapsible structures have recently become popular with both adults and children. Examples of such structures are shown and described in U.S. Pat. No. 5,038,812 (Norman), U.S. Pat. No. 5,467,794 (Zheng) and U.S. Pat. No. 5,560, 385 (Zheng). These structures may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performace, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

SUMMARY OF THE DISCLOSURE

The present invention provides a collapsible structure which is convenient to use, to transport, and to store, and which offers a wide variety of uses to the user.

In order to accomplish the objects of the present invention, the collapsible structures according to the present invention are provided with first and second wall panels, each wall panel having a foldable frame member having a folded and an unfolded orientation, a frame retaining sleeve for retaining the respective frame member, and a fabric material substantially covering each frame member to form the panel for each frame member when the frame member is in the unfolded orientation. The fabric assumes the unfolded orientation of its associated frame member. The foldable frame member for each wall panel further includes a top side and a bottom side, with the frame retaining sleeve of the first wall panel stitched along the length of its top side to the frame retaining sleeve along the length of the top side of the second wall panel to form a hinged connection.

According to one embodiment of the present invention, the structure includes a top panel having a first side connected to the top side of the first wall panel, and a second side connected to the top side of the second wall panel. The structure also includes a base panel having separate first and second sides, a foldable frame member having a folded and an unfolded orientation, and a fabric material substantially covering the frame member to form the base panel when the frame member is in the unfolded orientation. The bottom sides of the first and second wall panels are connected to the first and second sides, respectively, of the base panel.

According to another embodiment of the present invention, the structure includes a first top panel having a first side connected to the top side of the first wall panel, and a second top panel having a first side connected to the top side of the second wall panel. The second top panel has a second side connected to a second side of the first top panel. The structure of this embodiment also includes a base panel having separate first and second sides, a foldable frame member having a folded and an unfolded orientation, and a fabric material substantially covering the frame member to form the base panel when the frame member is in the unfolded orientation. The bottom sides of the first and second wall panels are connected to the first and second sides, respectively, of the base panel.

According to another embodiment of the present invention, the structure includes a fabric, support panel, string or strap that interconnects the first sides of the first and second wall panels to define the limits at which the wall panels can spread away from each other.

The collapsible structures according to the present invention are convenient for use since they are easily and quickly folded and collapsed into a smaller size for transportation and storage.

DETAILED DESCRIPTION OF THE PREFERRED EMBODIMENTS

Figure 1:
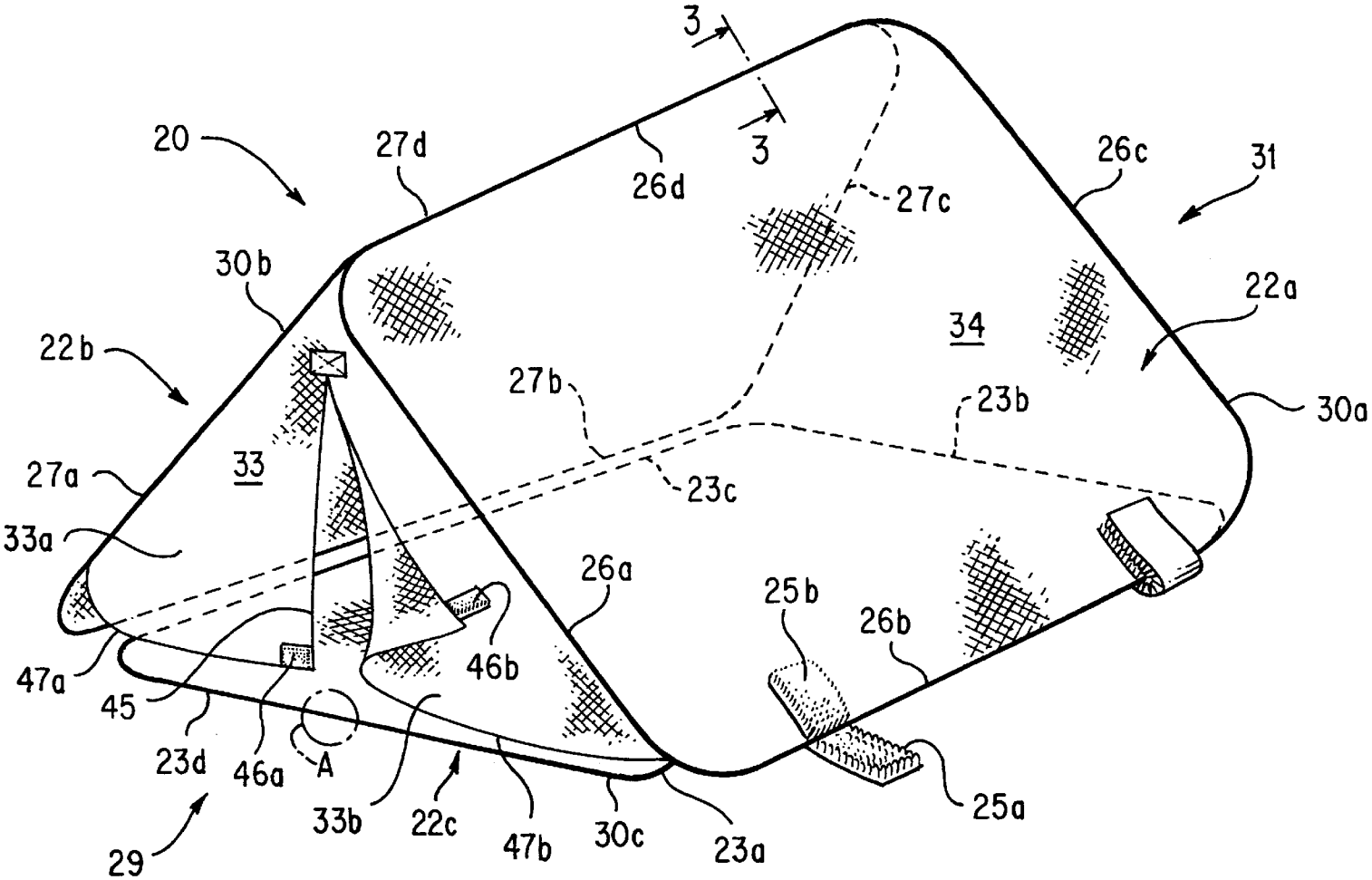
FIG. 1 is a perspective view of a collapsible structure according to a first preferred embodiment of the present invention shown in use in its expanded configuration.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

A first embodiment of the present invention is illustrated in connection with FIGS. 1 and 2. A collapsible structure 20 has three panels 22*a*, 22*b* and 22*c*, with a base panel 22*c* hingedly connected to a wall panel 22*b*, which is in turn hingedly connected to another wall panel 22*a* to form an enclosed space therewithin.

Each panel 22*a*, 22*b* and 22*c* has four side edges. The base panel 22*c* has two opposing side edges 23*a* and 23*c*, each having opposing ends connected to one of two opposing end edges 23*b* and 23*d*. The wall panel 22*a* has a left side edge 26*a*, a bottom side edge 26*b*, a right side edge 26*c*, and a top side edge 26*d*, while the wall panel 22*b* has a left side edge 27*a*, a bottom side edge 27*b*, a right side edge 27*c*, and a top side edge 27*d*. Each panel 22*a*, 22*b* and 22*c* has a continuous frame retaining sleeve 30*a*, 30*b* or 30*c* provided along and traversing the four edges of its four sides. A continuous frame member 32*a*, 32*b* or 32*c* is retained or held within each frame retaining sleeve 30*a*, 30*b* or 30*c*, respectively, to support each panel 22*a*, 22*b* and 22*c*. Only the frame member 32*c* is shown in FIG. 2; the other frame members 32*a* and 32*b* are not shown but are the same as frame member 32*c*.

The continuous frame members 32*a*, 32*b* and 32*c* may be provided as one continuous loop, or may be a strip of material connected at both ends to form a continuous loop. The continuous frame members 32*a*, 32*b* and 32*c* are preferably formed of flexible coilable steel, although other materials such as plastics may also be used. The frame members 32*a*, 32*b* and 32*c* should be made of a material which is relatively strong and yet is flexible to a sufficient degree to allow it to be coiled. Thus, each frame member 32*a*, 32*b* and 32*c* is capable of assuming two positions, an open or expanded position such as shown in FIG. 1, or a folded position in which the frame member is collapsed into a size which is much smaller than its open position (see FIG. 5E).

The frame members 32*a*, 32*b* and 32*c* may be merely retained within the respective frame retaining sleeves 30*a*, 30*b* and 30*c* without being connected thereto. Alternatively, the frame retaining sleeves 30*a*, 30*b* and 30*c* may be mechanically fastened, stitched, fused, or glued to the frame members 32*a*, 32*b* and 32*c*, respectively, to retain them in position.

Fabric or sheet material 34 extends across each panel 22*a*, 22*b* and 22*c*, and is held taut by the respective frame members 32*a*, 32*b* and 32*c* when in its open position. The term fabric is to be given its broadest meaning and should be made from strong, lightweight materials and may include woven fabrics, sheet fabrics or even films. The type of fabric used will depend on the intended application. For example, a stronger and more durable fabric will be used if the structure is intended for outdoor use, such as for camping. The fabric should be water-resistant and durable to withstand the wear and tear associated with rugged outdoor use or rough treatment by children.

Referring to FIG. 1, the bottom side edge 27*b* of wall panel 22*b* is hingedly connected to side edge 23*c* of the base panel 22*c*, and the top side edge 27*d* of wall panel 22*b* is hingedly connected to the top side edge 26*d* of wall panel 27*a*. The bottom side edge 26*b* of wall panel 22*a* is removably connected to the side edge 23*a* of base panel 22*c* by a conventional attachment mechanism, such as one or more pairs of opposing velcro pads 25*a* and 25*b* that are provided along edges 23*a* and 26*b*, respectively. Other conventional attachment mechanisms, such as but not limited to hooks, fasteners, buttons, snap-fit engagements, loops, snap buckles, zippers and ties, can also be used without departing from the spirit and scope of the present invention.

The two opposing ends 29 and 31 of the structure 20 are provided with a fabric covering. The fabric covering 33 interconnects the left side edges 26*a* and 27*a* of the wall panels 22*a* and 22*b*, respectively, and a similar fabric covering interconnects the right side edges 26*c* and 27*c* of the wall panels 22*a* and 22*b*, respectively. A slit 45 is provided in fabric covering 33 and defines two fabric portions 33*a* and 33*b*. The bottom edges 47*a* and 47*b* of the portions 33*a* and 33*b* are not connected to the edge 23*d* of base panel 22*c*. Therefore, the slit 45 functions to create an opening to provide ingress and egress to the interior of the structure 20. Velcro pads 46*a* and 46*b* are provided on the fabric portions 33*a* and 33*b* to secure the portions 33*a* and 33*b* together to close the opening.

The words "hingedly connected" or "hinged connection" when used herein means permanently connecting or attaching two adjacent sides of adjacent panels in a manner in which the connection is not intended to be dis-connected during normal use of the structure. FIG. 3A illustrates one preferred method for hingedly connecting top side edge 27*d* of wall panel 22*b* and the top side edge 26*d* of wall panel 22*a*. The fabric pieces 34*a* (for panel 22*a*) and 34*b* (for panel 22*b*) are folded over at their edges at the edges 26*a*, 26*c*, 27*a* and 27*c* to define the respective sleeves 30*a* and 30*b* in the manner described below in connection with FIG. 2. The fabric pieces 34*a* and 34*b* are stitched at their edges by a stitching 36 to the respective sleeves 30*a* and 30*b*. Each sleeve 30*a* and 30*b* may be formed by folding a piece of fabric and having its ends connected by stitching 36. The stitching 36 also acts as a hinge for the panels 22*a* and 22*b* to be folded upon each other, as explained below.

Figure 3A:
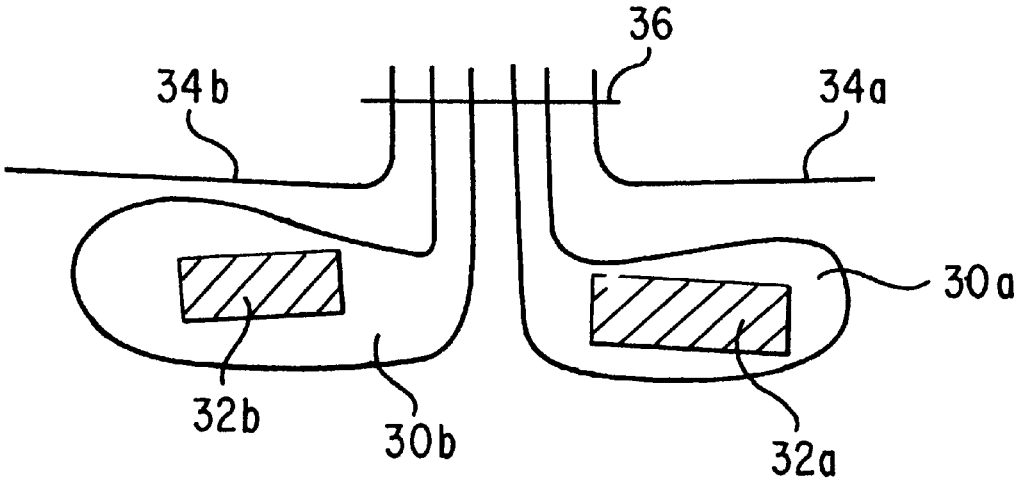
FIGS. 3A–3F and 4 are cross-sectional views of seven different preferred connections between two adjacent panels of the structure of FIG. 1 taken along line 3—3 thereof.
Figure 3B:
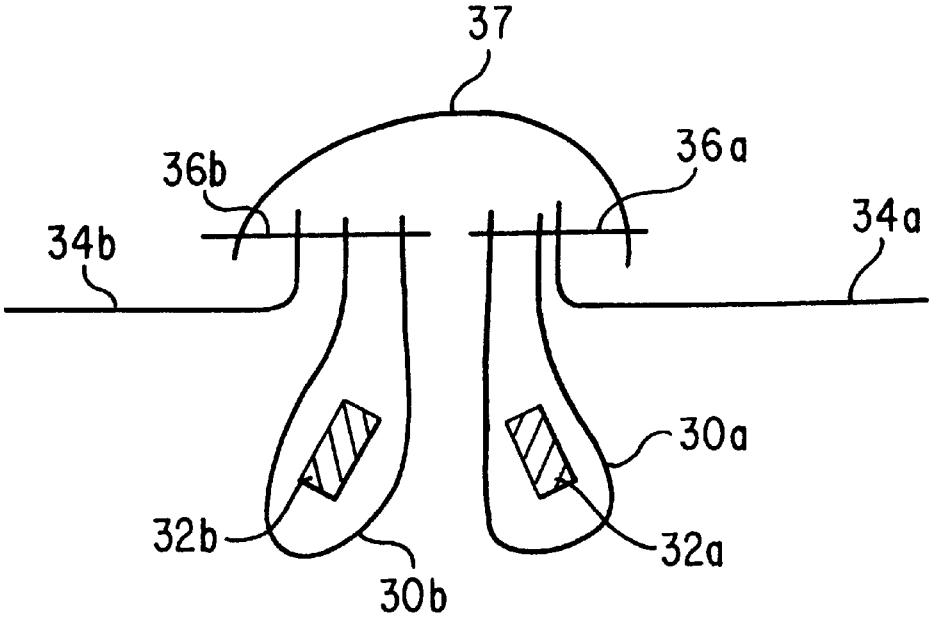

FIG. 3B illustrates a second preferred method for hingedly connecting top side edge 27*d* of wall panel 22*b* and the top side edge 26*d* of wall panel 22*a*. The fabric piece 34*a* and its sleeve 30*a* are stitched by a stitching 36*a* to one end of an interconnecting fabric piece 37, and the fabric piece 34*b* and its sleeve 30*b* are stitched by another stitching 36*b* to another end of the interconnecting fabric piece 37, which therefore acts as an interconnecting hinge for the panels 22*a* and 22*b*.

Figure 3C:
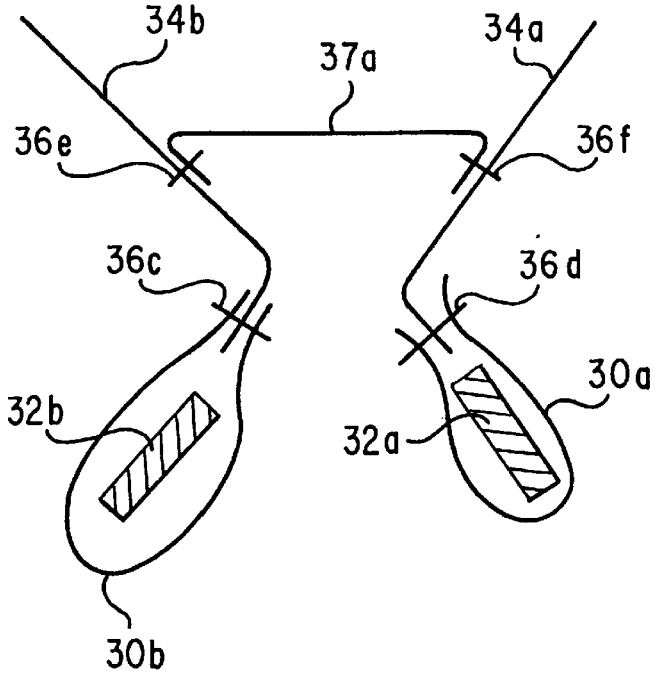

FIG. 3C illustrates a third preferred method for hingedly connecting top side edge 27*d* of wall panel 22*b* and the top side edge 26*d* of wall panel 22*a*. The fabric piece 34*a* and its sleeve 30*a* are connected by a stitching 36*d*, and the fabric piece 34*b* and its sleeve 30*b* are connected by another stitching 36*c*. An interconnecting fabric piece 37*a* is connected to fabric pieces 34*a* and 34*b* by stitchings 36*f* and 36*e*, respectively, at locations offset interiorly from the sleeves 30*a* and 30*b*. The interconnecting fabric piece 37*a* therefore acts as an interconnecting hinge for the panels 22*a* and 22*b*.

Figure 3E:
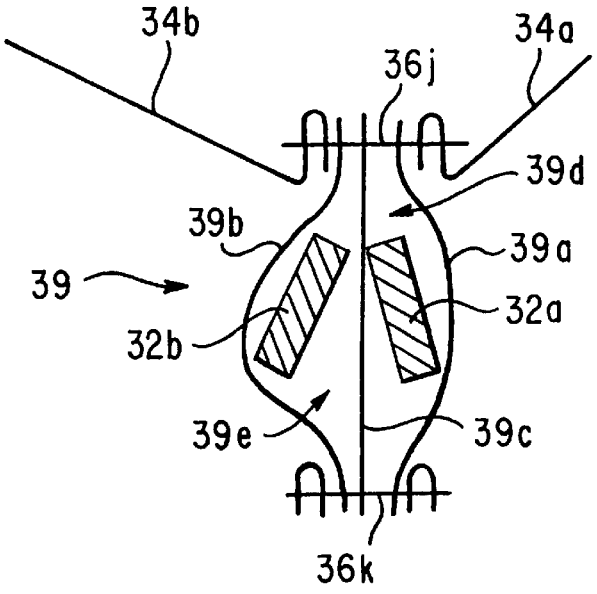
Figure 3D:
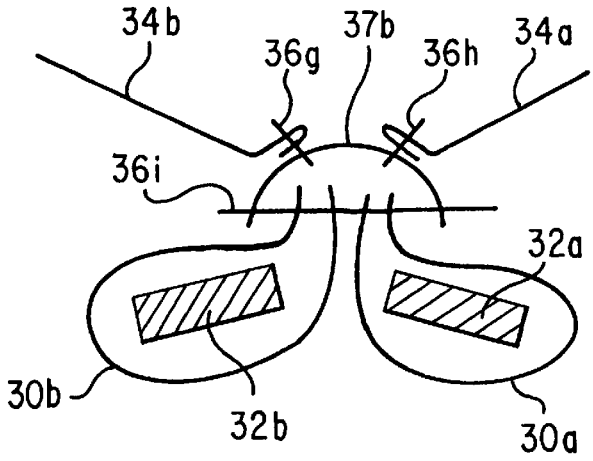

FIG. 3D illustrates a fourth preferred method for hingedly connecting top side edge 27*d* of wall panel 22*b* and the top side edge 26*d* of wall panel 22*a*. The fabric pieces 34*a* and 34*b* are connected by stitchings 36*h* and 36*g*, respectively, to spaced-apart locations of interconnecting fabric piece 37*b*. Interconnecting fabric piece 37*b* is in turn connected, at both its ends by stitching 36*i*, to sleeves 30*a* and 30*b*. Thus, the interconnecting fabric piece 37*b* acts as an interconnecting hinge for the panels 22*a* and 22*b*, and actually connects sleeves 30*a*, 30*b* and fabric pieces 34*a* , 34*b*.

FIG. 3E illustrates a fifth preferred method for hingedly connecting top side edge 27*d* of wall panel, 22*b* and the top side edge 26*d* of wall panel 22*a*. The frame retaining sleeves 30*a* and 30*b* converge at, or are connected to, one sleeve assembly 39 which is connected to the fabric pieces 34*a* and 34*b* by stitching 36*j*. The sleeve assembly 39 has two sleeve compartments 39*d* and 39*e* for holding frame members 32*a* and 32*b*, respectively. The sleeve compartments 39*d* and 39*e* are formed by stitching the opposing ends of three sleeve portions 39*a*, 39*b* and 39*c* through the use of stitchings 36*j* and 36*k*. The sleeve portion 39*c* acts both as a divider and to define the sleeve compartments 39*d* and 39*e*. The stitching 36*j* acts as an interconnecting hinge for the panels 22*a* and 22*b*.

Figure 3F:
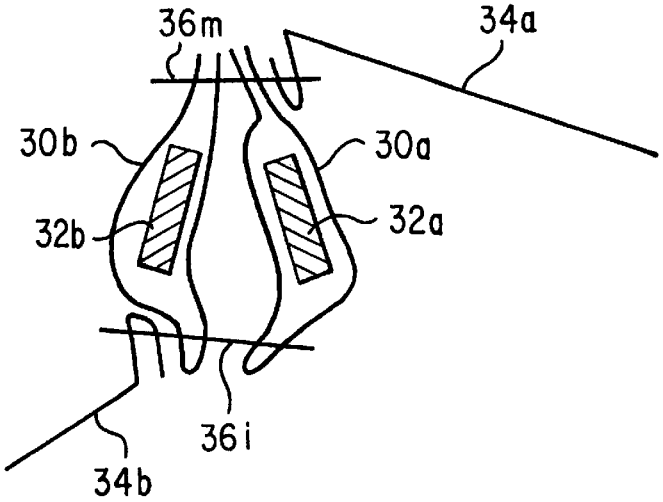

FIG. 3F illustrates a sixth preferred method for hingedly connecting top side edge 27*d* of wall panel 22*b* and the top side edge 26*d* of wall panel 22*a*. The fabric piece 34*b* is connected by stitching 361 to one end of sleeves 30*a* and 30*b*, and the fabric piece 34*a* is connected by stitching 36*m* to the opposing end of sleeves 30*a* and 30*b*. The sleeves 30*a* and 30*b* are formed by stitching the opposing ends of two sleeve portions with the stitchings 361 and 36*m*. Thus, the stitchings 361 and 36*m* act as interconnecting hinges for panels 22*a* and 22*b*.

Figure 4:
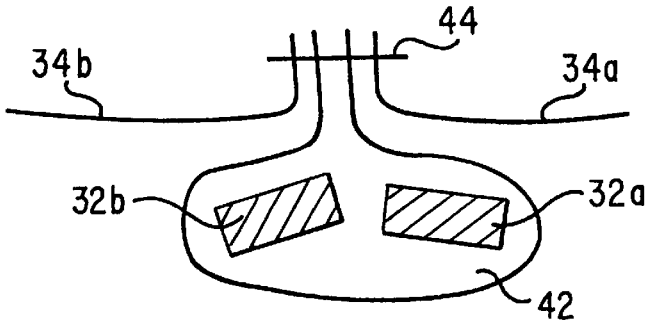

FIG. 4 illustrates a seventh preferred method for hingedly connecting top side edge 27*d* of wall panel 22*b* and the top side edge 26*d* of wall panel 22*a*. However, the frame retaining sleeves 30*a* and 30*b* converge at, or are connected to, one sleeve portion which interconnects panels 22*a* and 22*b* to form a singular frame retaining sleeve 42 which retains the frame members 32*a* and 32*b*. Sleeve 42 may be formed by providing a tubular fabric, or by folding a piece of fabric, and applying a stitching 44 to its edges to connect the sleeve 42 to the fabric pieces 34*a* and 34*b*. Stitching 44 acts as an interconnecting hinge for the panels 22*a* and 22*b*.

Figure 2:
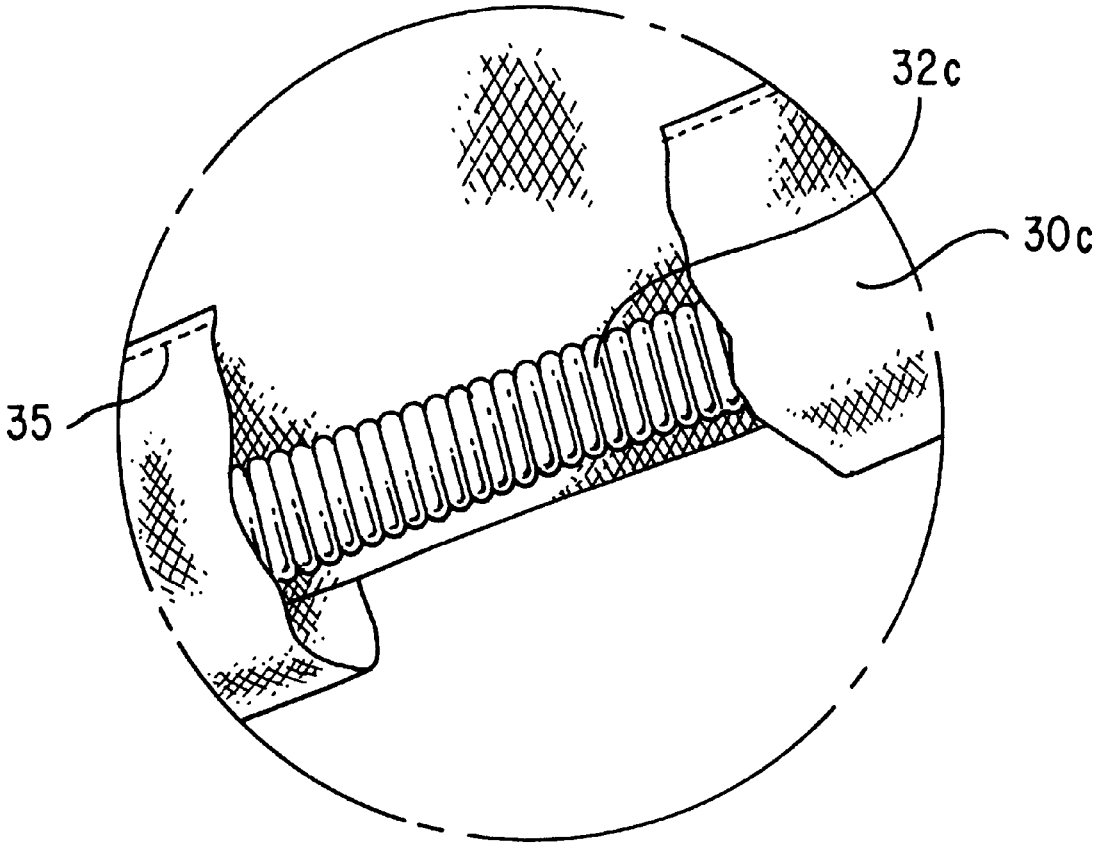
FIG. 2 is a partial cut-away view of the section A of the structure of FIG. 1 illustrating a frame member retained within a sleeve.

For the embodiments of FIGS. 3A–3F and 4, at the edges 23*d*, 23*b* , 26*a*, 26*c*, 27*a* and 27*c* which are not hingedly connected to another edge, the frame retaining sleeve 30*a*, 30*b* or 30*c* may be formed by merely folding over the corresponding fabric piece and applying a stitching 35 (see FIG. 2). Instead, the fabric portion 33*a* is connected to edge 27*a*, and the fabric portion 33*b* is connected to edge 26*a*, by stitching the fabric portions 33*a* and 33*b* to the frame retaining sleeves 30*a* or 30*b*. The fabric covering at the end 31 is likewise attached by stitching the edges of the fabric covering to the frame retaining sleeves 30*a* and 30*b* while leaving the bottom edges unconnected. A slit is optional at the end 31.

Although only the connection of the edges 26*d* and 27*d* is illustrated in FIGS. 3A–3F and 4, the side edge 23*c* of base panel 22*c* and the bottom side edge 27*b* of wall panel 22*b* may be hingedly connected by using one of the methods described above, or by a combination of any of these methods.

It will also be appreciated by those skilled in the art that the removable connections achieved by the attachment mechanisms described above can also act as hinges between adjacent side edges of adjacent panels. The difference between the removable connections and the hinge connections is that the removable connections can be detached without destroying the ability of re-attaching the connection using the same attachment mechanism.

Openings (not shown) may be provided in some or all of the panels 22*a*, 22*b* and 22*c*. These openings may be of any shape (e.g., triangular, circular, rectangular, square, diamond, etc.) and size and are designed and dimensioned to allow the user to crawl through them to enter or to exit the structure 20.

To assemble the structure 20 of FIG. 2 to the fully deployed configuration shown in FIG. 1, the user first rests all three panels 22*a*, 22*b* and 22*c* on the ground or surface. Using the panel 22*c* as a base, the user folds the wall panel 22*b* upwardly about its hinge connection (between side edges 23*c* and 27*b*) with the base panel 22*c* and then wraps or folds the wall panel 22*a* about its hinge connection (between side edges 26*d* and 27*d*) with wall panel 22*b* so that bottom side edge 26*b* of wall panel 22*a* is adjacent side edge 23*a* of base panel 22*c*. The user manually connects the side edges 26*b* and 23*a* by connecting the attachment mechanism, such as the opposing velcro pads 25*a* and 25*b*.

Figure 5A:
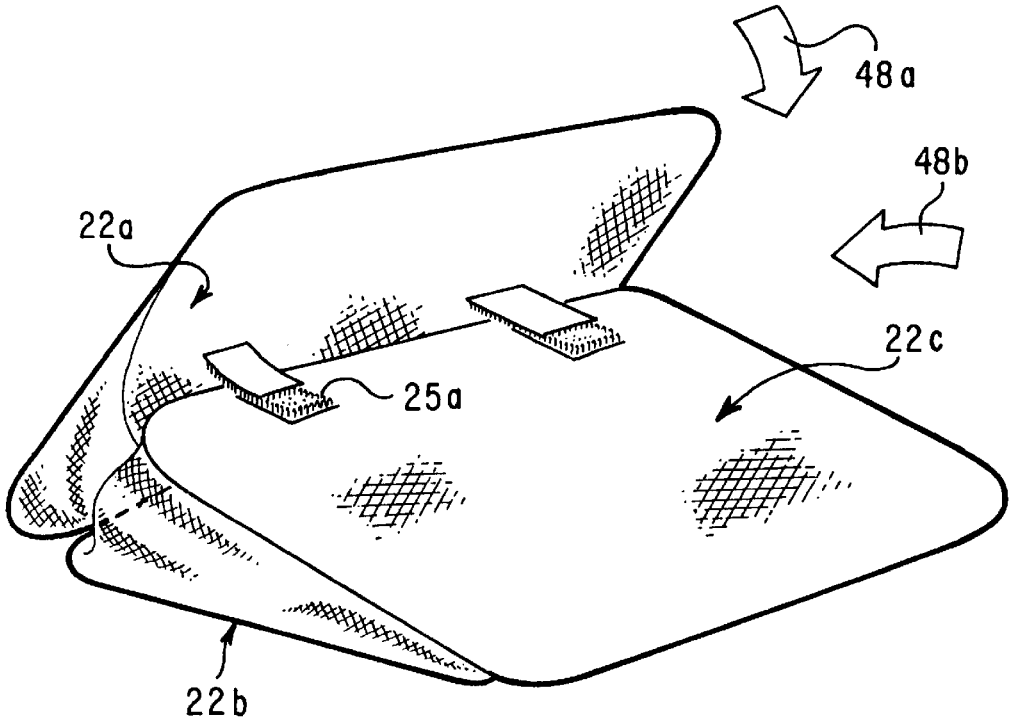
FIGS. 5(A) through 5(E) illustrate how the structure of FIG. 1 may be twisted and folded for compact storage.
Figure 5B:
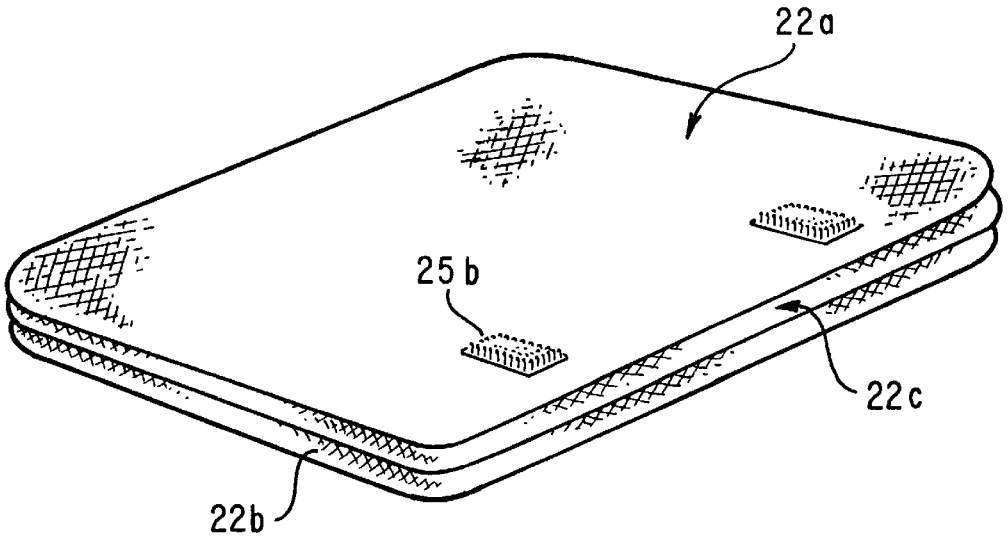

FIGS. 5A through 5E describe the steps for disassembling and collapsing the structure 20 into a compact configuration for storage. In the first step, the user detaches the attachment mechanism between side edges 26*b* and 23*a*. The three panels 22*a*, 22*b* and 22*c* are then laid flat on the ground. As illustrated in FIG. 5A, panel 22*c* is folded about its hinge connection between edges 23*c* and 27*b* so that panel 22*c* is folded onto and overlies the panel 22*b*, as indicated by the arrow 48*b*. Panel 22*a* is then folded about its hinge connection between edges 26*d* and 27*d* so that panel 22*a* is folded onto and overlies the panel 22*c*, as indicated by the arrow 48*a*, so that the three panels 22*a*, 22*b* and 22*c* now rest one on top of the other in a stack (see FIG. 5B). The structure is then ready to be twisted and folded to collapse the frame members and panels into a smaller shape.

Figure 5C:
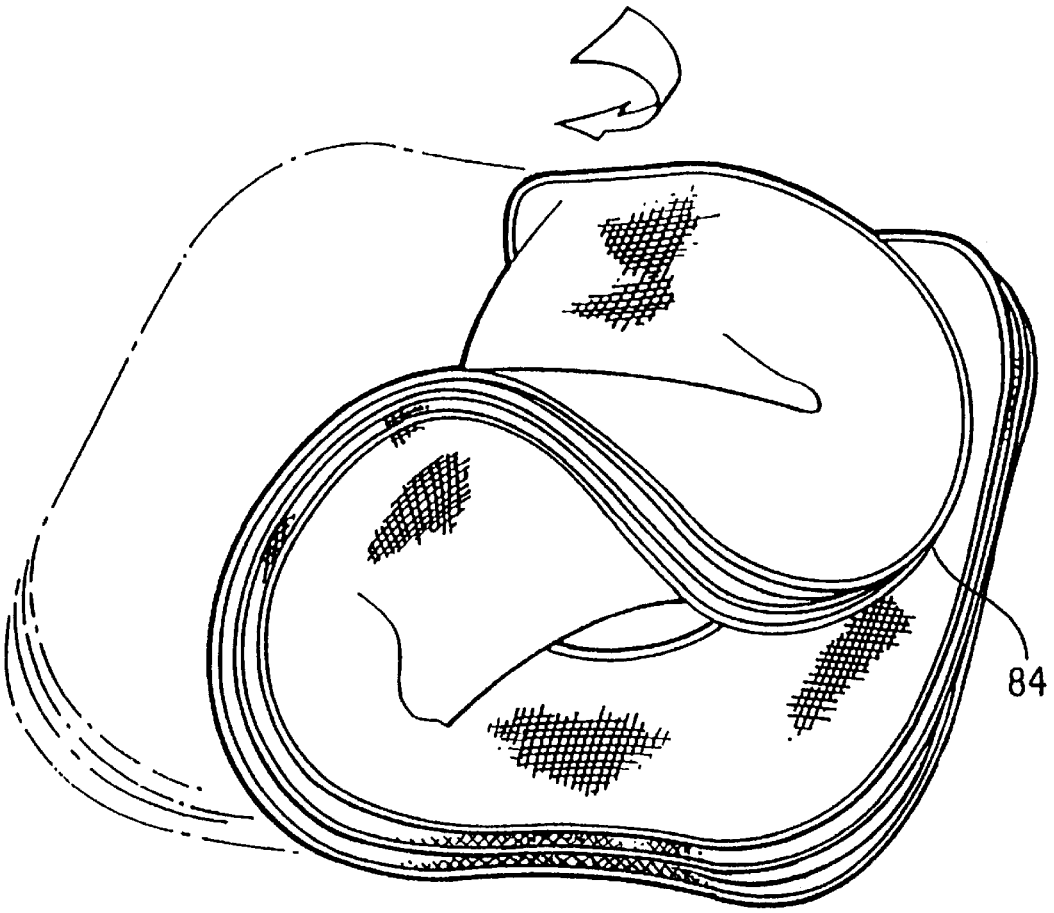
Figure 5D:
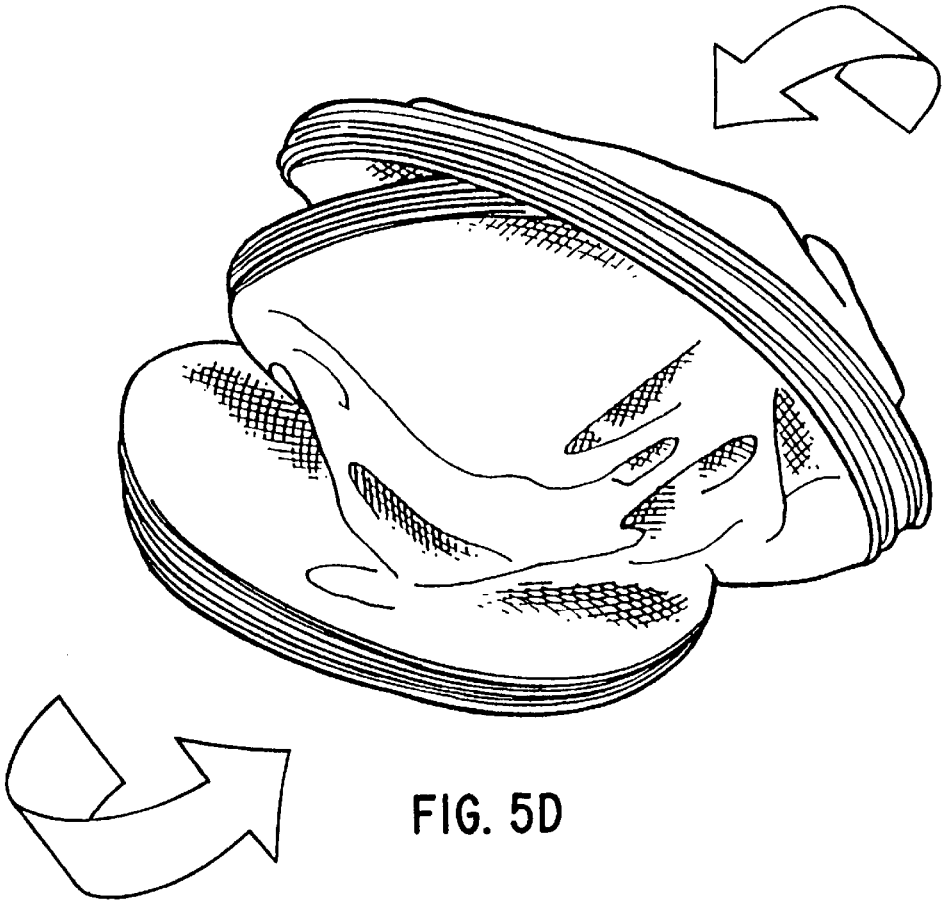
Figure 5E:
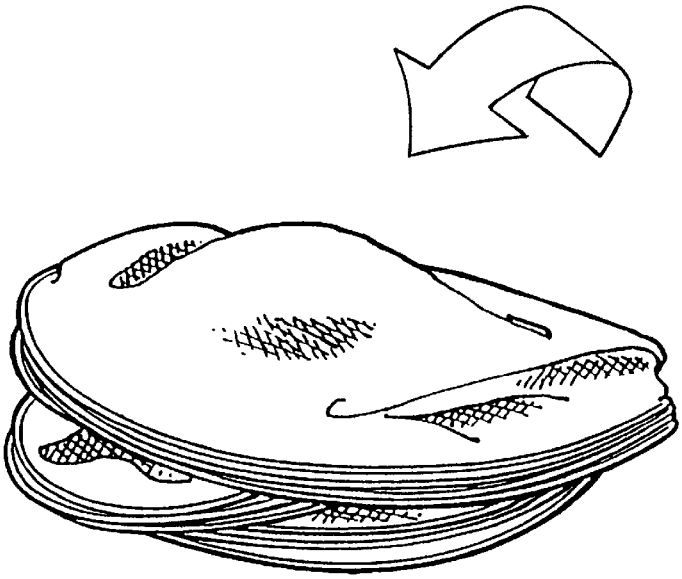

In the second step shown in FIG. 5C, the opposite border 84 of the structure 20 is folded in upon the previous fold to further collapse the frame members with the panels. As shown in FIG. 5D, the third step is to continue the collapsing so that the initial size of the structure is reduced. FIG. 5E shows the fourth step with the frame members and panels collapsed on each other to provide for a small essentially compact configuration having a plurality of concentric frame members and fabric layers of the panels so that the collapsed structure has a size which is a fraction of the size of the initial structure. During the folding and collapsing steps of FIGS. 5A–5E, the fabric coverings, such as 33, are tucked between the panels and folded and collapsed together with the panels.

Figure 6:
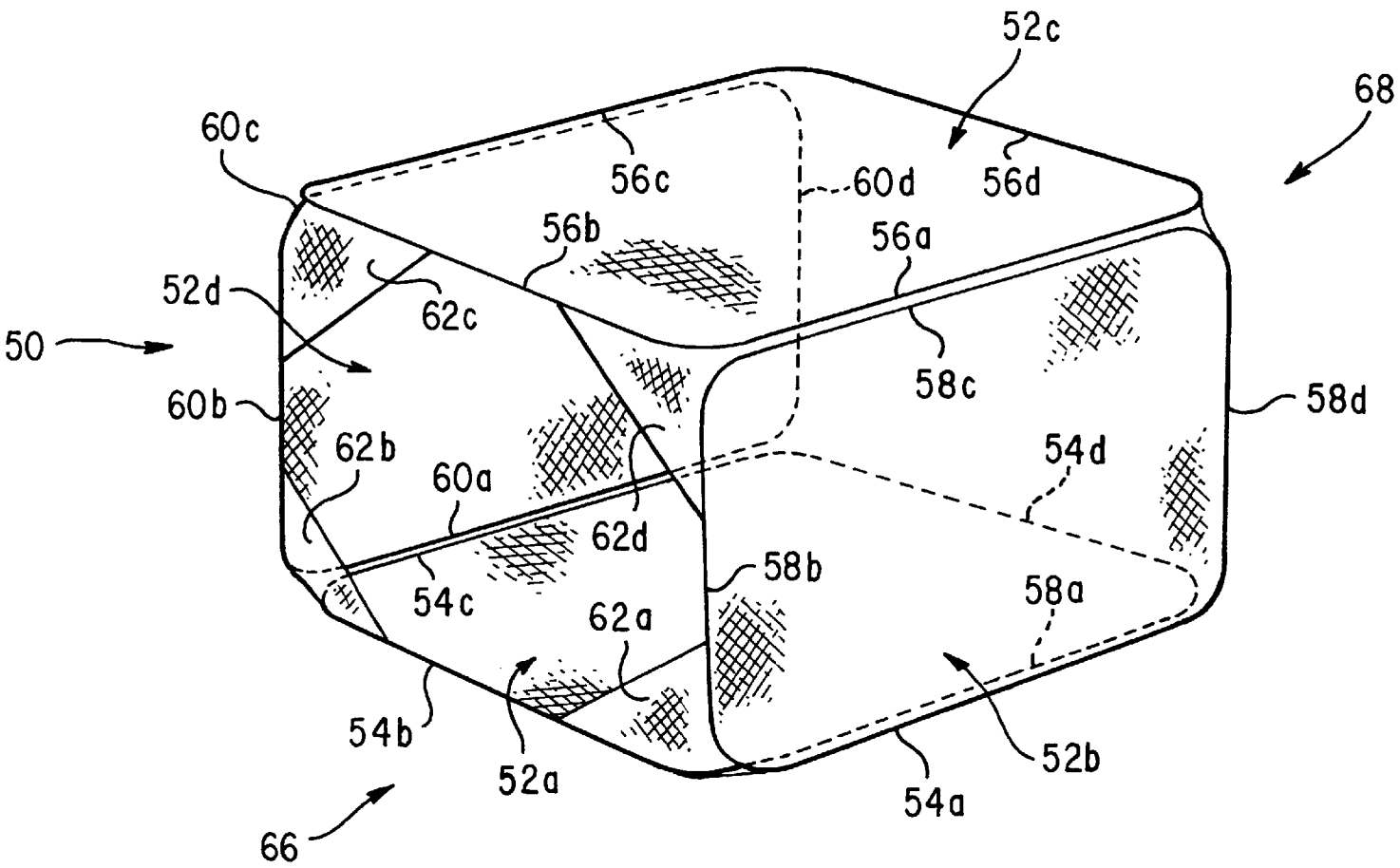
FIG. 6 is a perspective view of a collapsible structure according to a second preferred embodiment of the present invention shown in use in its expanded configuration.

A second preferred embodiment of the present invention is shown in FIG. 6. The structure 50 has four panels, a base panel 52*a*, wall panels 52*b* and 52*d*, and a top panel 52*c* hingedly connected to each other to encircle an enclosed space. Each panel 52*a*, 52b, 52*c* and 52*d* has four sides. Specifically, the base panel 52*a* has two side edges 54*a* and 54*c*, and two end edges 54*b* and 54*d*. The top panel 52*c* likewise has two side edges 56*a* and 56*c*, and two end edges 56*b* and 56*d*. The wall panel 52*b* has a bottom edge 58*a*, a left edge 58*b*, a top edge 58*c* and a right edge 58*d*. Similarly, the wall panel 52*d* has a bottom edge 60*a*, a left edge 60*b*, a top edge 60*c* and a right edge 60*d*. The structure of each panel 52*a*, 52*b*, 52*c* and 52*d*, including their fabric, frame members and sleeve portions, is the same as the panels 22*a*, 22*b* and 22*c* of the play structure 20, except that the shapes and sizes of the panels 52 may be different from the shapes and sizes of the panels 22.

Opposing side edges 54*a* and 54*c* of base panel 52*a* are hingedly connected to bottom edges 58*a* and 60*a* of wall panels 52*b* and 52*d*, respectively. Opposing side edges 56*a* and 56*c* of top panel 52*c* are hingedly connected to top edges 58*c* and 60*c* of wall panels 52*b* and 52*d*, respectively. The hinged connections of the side edges of the structure 50 may be accomplished by the hinge connection mechanisms described above for the structure 20.

Triangular fabric pieces 62*a*, 62*b*, 62*c* and 62*d* are stitched or otherwise connected to each of the four corners at opposite ends 66 and 68 of the structure 50. For example, fabric piece 62*a* is connected to the corner defined by the left edge 58*b* of wall panel 52*b* and end edge 54*b* of base panel 52*a*. Fabric piece 62*b* is connected to the corner defined by the left edge 60*b* of wall panel 52*d* and end edge 54*b* of base panel 52*a*. Fabric piece 62*c* is connected to the corner defined by the left edge 60*b* of wall panel 52*d* and end edge 56*b* of top panel 52*c*. Fabric piece 62*d* is connected to the corner defined by the left edge 58*b* of wall panel 52*b* and end edge 56*b* of top panel 52*c*. Therefore, the end 66 of structure 50 is substantially open. Similar fabric pieces may be provided at the opposite end 68 of the structure 50, or that end 68 may be completely closed off by stitching a piece of fabric to the edges 54*d*, 56*d*, 58*d* and 60*d*.

Alternatively, pieces of fabric acting as wall pieces can be attached to both ends 66 and 68 to close off both ends, with openings or slits provided in one or both of these fabric wall pieces, or in one or more of the panels 52*a*, 52*b*, 52*c* and 52*d*, to provide ingress and egress.

The structure 50 is preferably provided in the configuration shown in FIG. 6. To fold and collapse the structure 50 into a compact configuration for storage or transportation, panels 52*b* and 52*c* are pushed against panels 52*a* and 52*d*, respectively, about their hinged connections so that panels 52*b* and 52*c* rest against or overlie panels 52*a* and 52*d*, respectively. This folding action is facilitated by the hinge connections between adjacent side edges of adjacent panels. Two of the overlying panels 52*b* and 52*a*, or 52*c* and 52*d*, are then folded about their hinge connections onto the other two overlying panels, so that the four panels 52*a*, 52*b*, 52*c* and 52*d* overlie each other in a stack. The combined stack of panels are then twisted and folded in the manner described above in connection with FIGS. 5A–5E to collapse the structure 50 into a compact configuration.

Figure 7:
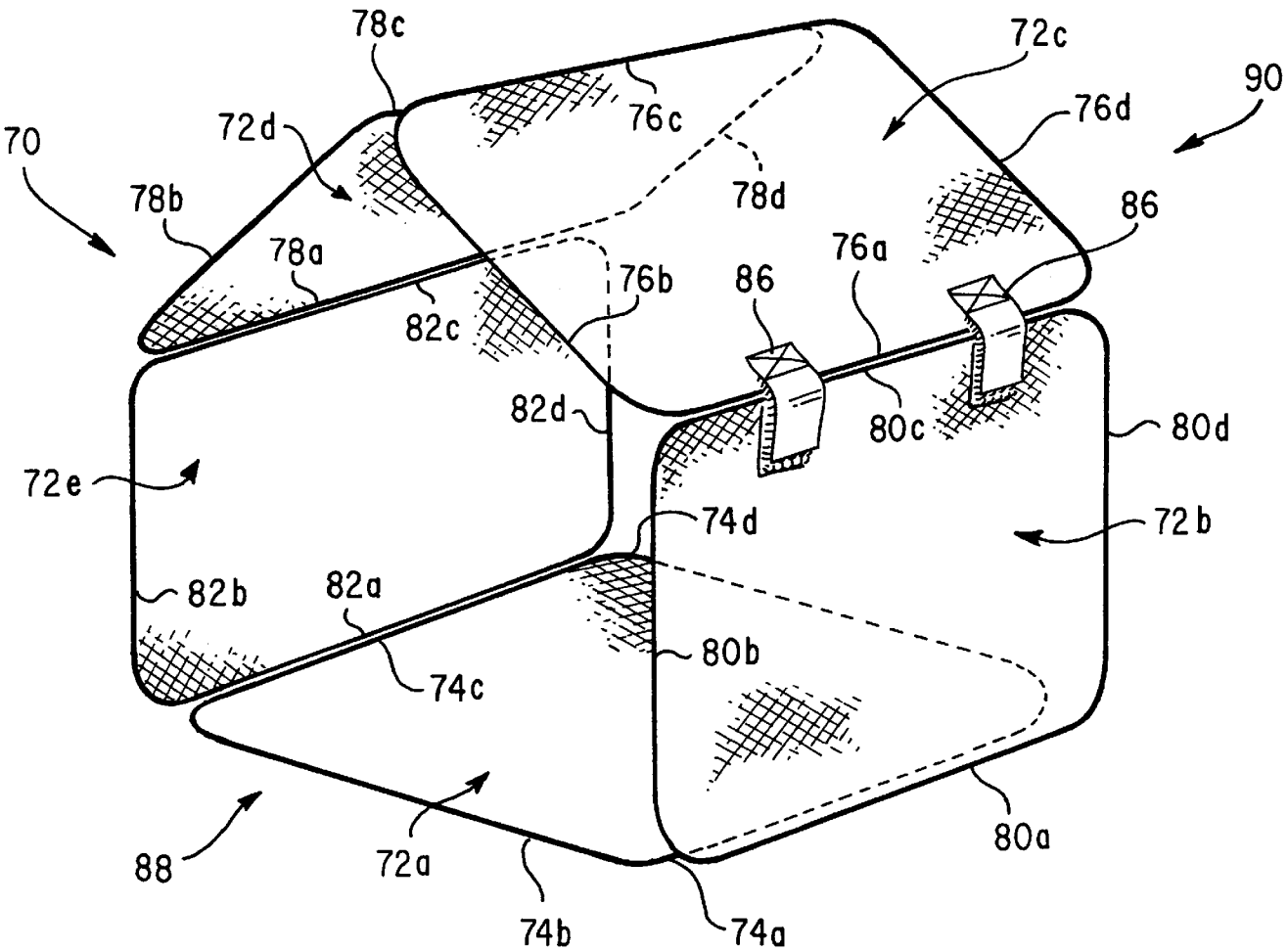
FIG. 7 is a perspective view of a collapsible structure according to a third preferred embodiment of the present invention shown in use its expanded configuration.

A third preferred embodiment of the present invention is shown in FIG. 7. A structure 70 has five panels: a base panel 72*a*, wall panels 72*b* and 72*e*, and top panels 72*c* and 72*d* connected to each other to encircle an enclosed space. Each panel 72*a*, 72*b*, 72*c*, 72*d* and 72*e* has four sides. Specifically, the base panel 72*a* has two side edges 74*a* and 74*c*, and two end edges 74*b* and 74*d*. The top panels 72*c* and 72*d* likewise have two side edges 76*a*, 76*c* and 78*a*, 78*c*, respectively, and two end edges 76*b*, 76*d* and 78*b*, 78*d*, respectively. The wall panel 72*b* has a bottom edge 80*a*, a left edge 80*b*, a top edge 80*c* and a right edge 80*d*. Similarly, the wall panel 72*e* has a bottom edge 82*a*, a left edge 82*b*, a top edge 82*c* and a right edge 82*d* . The structure of each panel 72*a*, 72*b*, 72*c*, 72*d* and 72*e*, including their fabric, frame members and sleeve portions, is the same as the panels 22*a*, 22*b* and 22*c* of the play structure 20, except that the shapes and sizes of the panels 72 may be different from the shapes and sizes of the panels 22.

Opposing side edges 74*a* and 74*c* of base panel 72*a* are hingedly connected to bottom edges 80*a* and 82*a* of wall panels 72*b* and 72*e*, respectively. Top edge 82*c* of wall panel 72*e* is hingedly connected to side edge 78*a* of top panel 72*d*. Side edge 78*c* of top panel 72*d* is hingedly connected to side edge 76*c* of top panel 72*c*. The hinged connections of the side edges of the structure 70 may also be accomplished by the hinge connection mechanisms described above for the structure 20.

Top edge 80*c* of wall panel 72*b* is removably connected to side edge 76*a* of top panel 72*c* by any of the attachment mechanisms described above. In FIG. 7, opposing Velcro pads 86 are provided for removably connecting edges 80*c* and 76*a*.

Although FIG. 7 illustrates that top edge 80*c* of wall panel 72*b* is removably connected to side edge 76*a* of top panel 72*c*, it is also possible to provide the removable connection between any two adjacent side edges of any of the panels 72*a*, 72*b*, 72*c*, 72*d* and 72*e*, with the other adjacent side edges hingedly connected to each other.

The opposite ends 88 and 90 of the structure 70 may be left open, or may be completely or partially covered with fabric wall pieces or triangular fabric corner pieces as described above for structure 50. Openings or slits may also be provided at one or more of the panels or fabric wall pieces.

The structure 70 is illustrated in the fully deployed configuration in FIG. 7. To fold and collapse the structure 70 into a compact configuration for storage or transportation, the user detaches the attachment mechanism between side edges 80*c* and 76*a*. The panels are then folded over each other about their hinge connections so that they form a stack of five overlying panels. The combined stack of panels are then twisted and folded in the manner described above in connection with FIGS. 5A–5E to collapse the structure 70 into a compact configuration.

Figure 8:
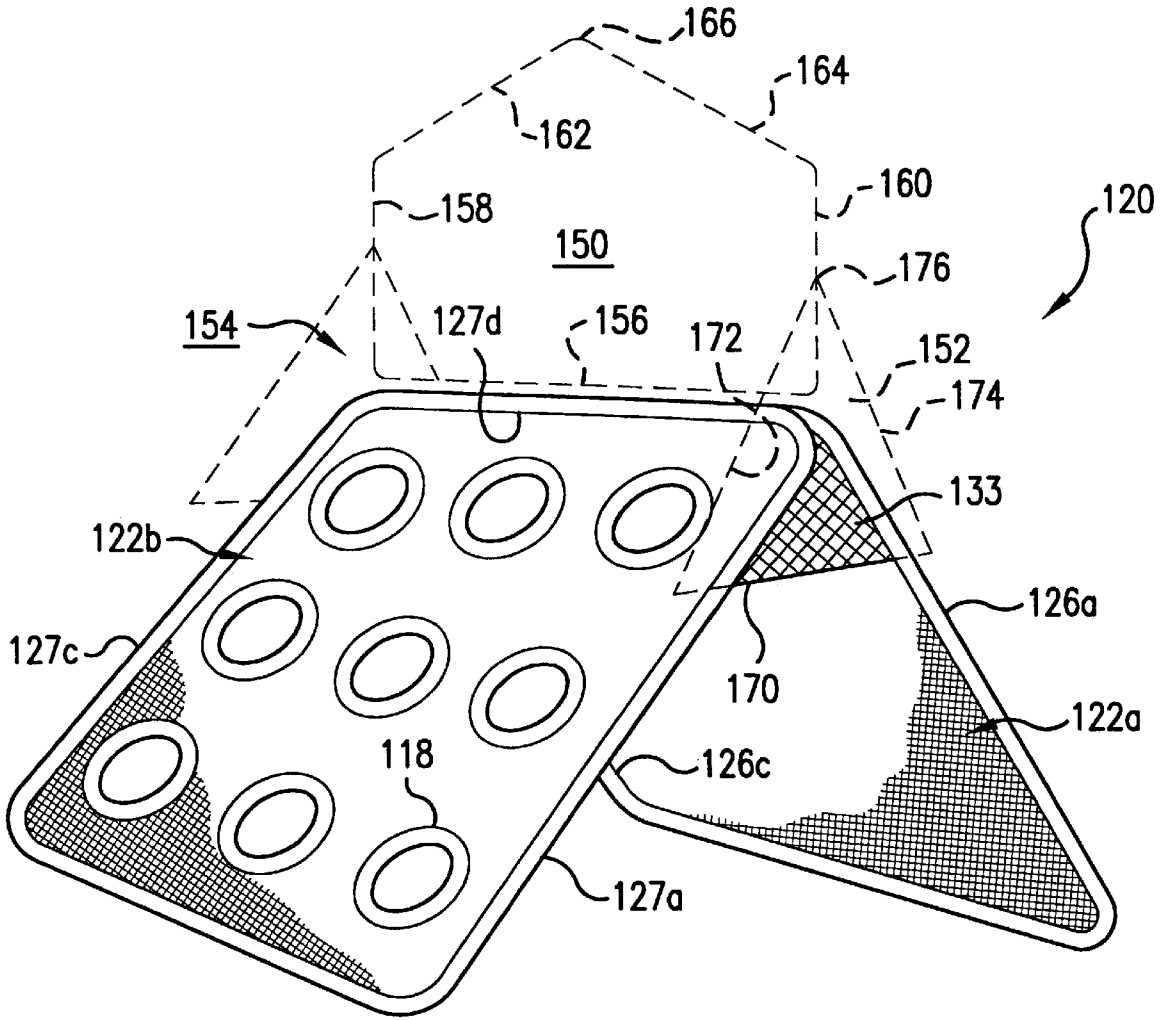
FIG. 8 is a perspective view of a collapsible structure according to a fourth preferred embodiment of the present invention shown in use in its expanded configuration.

A fourth preferred embodiment of the present invention is shown in FIG. 8 in the form of structure 120, which is similar to structure 20 of FIG. 1 except that a base panel has been omitted. In particular, structure 120 has two panels 122*a* and 122*b*, which can have the same structure, sizes and shapes as panels 22*a* and 22*b*, and which are hingedly connected to each other in the same manner as panels 22*a* and 22*b* to form an enclosed space therewithin. Openings 118 can be provided in one or both panels 122*a* and/or 122*b* through which a ball or other object can be tossed. The object would pass through an opening 118 and come to rest in the enclosed space under the panels 122*a*, 122*b*, where it can be retrieved.

A fabric piece 133 can be stitched or otherwise attached between the panels 122*a*, 122*b* along side edges 126*a* and 127*a*, respectively, below the hinged connection. Alternatively, a strap or durable string can be connected between side edges 126*a* and 127*a* to perform the same function. This piece 133 (or strap or string) defines the limits at which the panels 122*a*, 122*b* can spread apart from each other when deployed in the upstanding configuration shown in FIG. 8. Another fabric piece (not shown) can also be stitched or otherwise attached between the panels 122*a*, 122*b* along the other side edges 126*c* and 127*c*, respectively, below the hinged connection to perform the same function. The fabric pieces 133 can be a short piece spanning a short distance along the side edges 126*a*, 127*a* and 126*c*, 127*a*, as shown in FIG. 8, or the fabric pieces 133 can extend all the way along these side edges to form fabric walls, such as those illustrated in FIG. 1. Slits can be provided in these fabric walls to provide ingress and egress, as described above.

The structure 120 can be disassembled and collapsed into a compact configuration for storage by first folding one panel 122*a* or 122*b* onto the other panel 122*b* or 122*a* about their hinge connection at their top edges 126*d* and 127*d*, and then twisting and folding the combined panels 122*a*, 122*b* according to the steps illustrated in connection with FIGS. 5B–5E. The fabric pieces 133 can be tucked between the panels 122*a*, 122*b* and twisted and folded together with the panels 122*a*, 122*b*.

As an alternative, the structure 120 can be modified to include three additional panels, which are shown in phantom in FIG. 8. In particular, a central panel 150 and two support panels 152 and 154 can be added. Each of these panels 150, 152, 154 include a resilient loop member and a fabric that spans the boundary of the loop member, as described above for the other panels. The central panel 150 can be configured with five sides, including a bottom side 156, a left side 158 and a right side 160 extending from opposite ends of the bottom side 156, a left angled upper side 162 extending from the top of the left side 158, and a right angled upper side 164 extending from the top of the right side 160 and connecting the left angled upper side 162 at an apex 166. In addition, support panels 152 and 154 may be identical in size and shape, and each includes, as a non-limiting example, a bottom side 170, a left diagonal side 172 and a right diagonal side 174 extending from opposite ends of the bottom side 170 and connecting at an apex 176. Support panels 154 and 152 are disengageably connected to the left and right sides 158 and 160, respectively, of the central panel 150 to hold and support the central panel 150 in a vertical, upright position during use. Each support panel 154, 152 is disengageably connected to the left and right sides 158, 160, respectively, at the apex 176 and/or along a central line running down the middle of the support panel 152, 154, as shown in phantom in FIG. 8. The central panel 150 can be connected to the top edges 126*d* (not shown) and 127*d* of the panels 122*a* and 122*b*, respectively, by either a hinged connection or a removable connection.

The disengageable connection of the support panels 152, 154 to central panel 150 can be accomplished in a number of ways. For example, a plurality of loops can be stitched or otherwise provided along the left and right sides 158, 160, and a plurality of toggles provided along the fabric, sides and/or apices of the support panels 152, 154, so that the connection can be achieved by slipping selected toggles through selected loops. As an alternative, tie members in the form of a strap or a strip of fabric can be provided on all the panels 150, 152, 154 and the opposing tie members tied together at selected locations to connect the panels 150, 152, 154. Those skilled in the art will appreciate that other disengageable connection methods, such as but not limited to opposing Velcro pads, hooks, snaps and detachable zippers, can be used without departing from the spirit and scope of the present invention.

The support panels 152, 154 can also be provided in lieu of the fabric pieces 133, since the support panels 152, 154 can also perform the same function of defining the limits at which the panels 122*a*, 122*b* can spread apart from each other when deployed in the upstanding configuration. When so configured, the central panel 150 can be omitted, and the support panels 152, 154 can be disengagably connected to the panels 122*a*, 122*b* using any of the techniques described above for disengagably connecting the support panels 152, 154 to the central panel 150. Thus, the structure 120 can be provided in a variety of different configurations: with or with the support panels 152 and 154, and with or without the central panel 150. The central panel 150 can be provided to support a basket (not shown) through which a ball can be tossed. Alternatively, one or more openings (not shown) can be provided in the central panel 150 through which an object can be tossed.

The structure 120 may be disassembled from the configuration shown in FIG. 8 by removing the disengageable connections between the central panel 150 and the support panels 152, 154. The central panel 150 can then be removed from the panels 122*a*, 122*b* (if connected by a removable connection), or folded upon either panel 122*a* or 122*b* (if connected by a hinged connection). The panels 122*a* and 122*b* can then be folded onto each other, and the other panels 152, 154 (and possibly 150) placed one on top of the other to form a stack of panels that can be twisted and folded in the manner described above to collapse the panels into a smaller shape. To reassemble or deploy the structure 120, the panels 122*a*, 122*b*, 150, 152, 154 are opened to their expanded configurations and the various removable and disengageable connections are made to provide the structure 120.

Play structures 20, 50, 70 and 120 are examples of simple structures that can be provided according to the present invention. However, it will be appreciated by those skilled in the art that structures having different and more complex configurations can also be provided according to the principles of the present invention. As a non-limiting example, structures having a larger number of panels and possible configurations can be provided. As another non-limiting example, while the panels of the structures according to the present invention are shown and described as having four sides, it is possible for each panel to have three or more sides. It is also possible to provide structures with a plurality of panels, each having a different number of sides. Thus, the structures of the present invention may take a variety of external shapes and sizes. However, each panel of the structure, regardless of its shape and size, is preferably supported by one continuous frame member.

In addition, although certain connections for the structures 20, 50, 70 and 120 are described as being hinged connections, it is possible to provide the connection between any pair of adjacent side edges of the panels as a removable connection instead of the hinged connection. Therefore, while structures 20, 70 and 120 are described as requiring at least one removable connection, it is possible to provide one or more of the hinged connections as removable connections. Also, although structures 20 and 70 are illustrated as having removable connections at certain specific side edges, it is understood that the removable connection can be provided at any adjacent side edges between two adjacent panels.

Similarly, while structure 50 is described as having four hinged connections and no removable connections, it is possible to provide one or more of the hinged connections as removable connections. The removable connections can be achieved by the attachment mechanisms described above. To fold and collapse a structure having panels connected by removable connections, the user merely removes these connections, and then folds and/or places the panels one on top of the other so that the panels of the structure overlie one another to form one stack of panels. The combined stack of panels are then twisted and folded in the manner described above in connection with FIGS. 5A–5E to collapse the structure into a compact configuration.

Thus, the structures according to the present invention may be provided in a variety of configurations in which the number of panels and the shape and size of the panels may be varied. The structures according to the present invention can be easily deployed and disassembled, and are easy to fold and collapse into a compact configuration for convenient storage or transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure having a deployed configuration and a collapsed configuration, comprising:

first and second foldable frame members, each frame member having a folded and an unfolded orientation;

a fabric material associated with each of the first and second frame members, the fabric material associated with the first frame member covering at least a portion of the first frame member and the fabric material associated with the second frame member covering at least a portion of the second frame member;

each foldable frame member having a top side, a bottom side, and a first side, with the first frame member and the second frame member connected to each other adjacent the top sides.

2. The structure of claim 1, further including means for interconnecting the first sides of the first and second frame members.

3. The structure of claim 2, wherein the interconnecting means comprises a first fabric interconnecting the first sides of the first and second frame members.

4. The structure of claim 3, wherein each of the first and second frame members further includes a second side, the structure further including means for interconnecting the second sides of the first and second frame members.

5. The structure of claim 3, wherein the first fabric extends from the top sides and downwardly along a portion of the first side of the first and second frame members.

6. The structure of claim 1, wherein the bottom side of each frame member rests on a surface.

7. The structure of claim 5, wherein the bottom side of each frame member rests on a surface, and the first fabric defines the limits at which the frame members can spread away from each other.

8. The structure of claim 2, wherein the interconnecting means comprises a support panel coupled to the first side of the first and second frame members.

9. The structure of claim 8, further including a central panel connected to the connection and extending vertically therefrom, the central panel disengageably connected to the support panel.

10. The structure of claim 1, further including a first frame retaining sleeve associated with the first frame member for retaining the first frame member, and a second frame retaining sleeve associated with the second frame member for retaining the second frame member.

11. The structure of claim 1, wherein the first and second frame members are placed on top of each other when the structure is twisted and folded to its collapsed configuration.

12. The structure of claim 1, further including:

a strap interconnecting the first and second frame members to define the limits at which the first and second frame members can spread apart from each other.

13. The structure of claim 1, wherein the first and second frame members are removably connected to each other adjacent the top sides.

14. The structure of claim 1, wherein the fabric associated with the first frame member includes an opening.

15. A collapsible structure having a deployed configuration and a collapsed configuration, comprising:

first and second side members, each side member having a foldable frame member having a folded and an unfolded orientation, a fabric material covering at least a portion of the associated frame member when the frame member is in the unfolded orientation; and the foldable frame member for each side member further having a top side, a bottom side, and a first side, with the first and second side members connected to each other adjacent the top sides of the first and second side members.

16. The structure of claim 15, wherein the bottom side of each side member rests on a surface.

17. The structure of claim 15, further including a first frame retaining sleeve associated with the first frame member for retaining the first frame member, and a second frame retaining sleeve associated with the second frame member for retaining the second frame member.

18. The structure of claim 15, wherein the first and second side members are placed on top of each other when the structure is twisted and folded to its collapsed configuration.

19. The structure of claim 15, wherein the first and second side members are removably connected to each other adjacent the top sides.

20. The structure of claim 15, wherein the fabric associated with the first side member includes an opening.

21. A collapsible structure having a deployed configuration and a collapsed configuration, comprising:

first and second side members, each side member including a portion of a foldable frame member that has a folded and an unfolded orientation, and a fabric material covering at least a portion of its frame member when the frame member is in the unfolded orientation; and each side member further having a top side, a bottom side, and a first side, with the first and second side members connected to each other adjacent the top sides;

wherein the first side member lies in a first uninterrupted plane and the second side member lies in a second uninterrupted plane, with the first and second planes extending at different angles.

22. The structure of claim 21, wherein the bottom side of each side member rests on a surface.

23. The structure of claim 21, further including a first frame retaining sleeve for retaining the portion of the frame member for the first side member, and a second frame retaining sleeve for retaining the portion of the frame member for the second side member.

24. The structure of claim 21, wherein the first and second side members are placed on top of each other when the structure is twisted and folded to its collapsed configuration.

25. The structure of claim 21, wherein the fabric associated with the first side member includes an opening.

* * * * *